US009797403B2

(12) United States Patent
Hsu

(10) Patent No.: US 9,797,403 B2
(45) Date of Patent: Oct. 24, 2017

(54) FAN

(71) Applicant: Ming-Hai Hsu, Taichung (TW)

(72) Inventor: Ming-Hai Hsu, Taichung (TW)

( * ) Notice: Subject to any disclaimer, the term of this patent is extended or adjusted under 35 U.S.C. 154(b) by 307 days.

(21) Appl. No.: 14/678,575

(22) Filed: Apr. 3, 2015

(65) Prior Publication Data

US 2015/0300368 A1 Oct. 22, 2015

(30) Foreign Application Priority Data

Apr. 18, 2014 (TW) ..... 103114158 A
Apr. 18, 2014 (TW) ..... 103114159 A

(51) Int. Cl.

| | |
|---|---|
| ***F04D 17/16*** | (2006.01) |
| ***F04D 29/28*** | (2006.01) |
| ***F04D 29/70*** | (2006.01) |
| ***F04D 29/66*** | (2006.01) |
| ***F04D 29/30*** | (2006.01) |

(52) U.S. Cl.

CPC ..... *F04D 17/16* (2013.01); *F04D 29/281* (2013.01); *F04D 29/30* (2013.01); *F04D 29/662* (2013.01); *F04D 29/703* (2013.01)

(58) Field of Classification Search

CPC ..... F04D 17/16; F04D 25/088; F04D 29/281; F04D 29/30; F04D 29/662; F04D 29/703

See application file for complete search history.

(56) References Cited

U.S. PATENT DOCUMENTS

| | | | | |
|---|---|---|---|---|
| 5,489,191 | A * | 2/1996 | Tai | F04D 29/646 416/5 |
| 5,883,449 | A * | 3/1999 | Mehta | F04D 25/082 310/417 |
| 6,746,210 | B2 * | 6/2004 | Kim | B29C 45/33 416/181 |
| 6,798,098 | B1 * | 9/2004 | Tai | F04D 25/088 310/52 |
| 7,670,115 | B2 * | 3/2010 | Cho | F04D 29/281 416/186 R |
| 8,109,731 | B2 * | 2/2012 | Keber | F04D 29/023 416/186 R |
| 2008/0159865 | A1 * | 7/2008 | Lee | F04D 29/282 416/179 |
| 2014/0348658 | A1 * | 11/2014 | Cunnane | F04D 25/088 416/223 R |

FOREIGN PATENT DOCUMENTS

| | | |
|---|---|---|
| TW | M373411 | 2/2010 |

* cited by examiner

*Primary Examiner* — Woody Lee, Jr.
*Assistant Examiner* — Eric Zamora Alvarez
(74) *Attorney, Agent, or Firm* — Muncy, Geissler, Olds & Lowe, P.C.

(57) ABSTRACT

A fan is provided, including a driving member, a fan bracket, a main fan and a main cover. The fan bracket is assembled with the driving member. The main fan is disposed on a first connecting portion of the fan bracket. The main cover is disposed on a second connecting portion of the fan bracket. An airflow space is formed between the main fan and the main cover. The main cover is formed with a first wind-guiding cover. Thereby, when the driving member drives the main fan to rotate, air can be inhaled through the first wind-guiding cover into the airflow space, and air will be exhaled toward a periphery of the airflow space by using a guidance of the first wind-guiding cover.

17 Claims, 10 Drawing Sheets

FAN

BACKGROUND OF THE INVENTION

Field of the Invention

The present invention relates to a fan structure provided for being mounted in an interior space to enhance airflow circulation.

Description of the Prior Art

Please refer to TWM373411 for a conventional fan structure. An outlet is disposed at a center of a base, and a plurality of curved sheets are disposed around the outlet in equal divisions. A connection of a head and a tail of each curved sheet has an inlet gap. A plurality of inlets in different types are arranged around the base. A center of the outlet is formed with a motor base through connecting with each curved sheets via an enhancing rib, and the motor base is for a motor to be arranged thereon. An inner end of a rotating shaft of the motor is formed with a fan, and an outer end of the rotating shaft is formed with a web for adjusting wind directions. When the fan is on, air is inhaled through the inlets around the base, and some air flows over the curved sheets and is exhaled via the outlet.

However, the conventional design can only exhale airflow downward, so airflow is overly concentrated, the wind speed right under the fan is too high and air surrounding the fan cannot be circulated. Hence, the airflow circulation effect of the fan structure needs to be improved.

In addition, the fan is mainly composed of a motor and fan blades, and the motor drives the fan blades to rotate to create airflow. In order to prevent the fan from making vibration or noises during the operating process, counterweight blocks are mounted on certain parts of the fan during the assembling process to balance the fan and to make the fan rotate more smoothly and quietly. However, mounting the counterweight blocks is a delicate work, and it is so difficult, time-consuming and energy-consuming that a common consumer cannot mount the counterweight blocks by himself/herself. Furthermore, the counterweight blocks may dislocate when the fan rotates and make the fan lose balance; therefore, the balance adjustment of the fan needs to be improved.

The present invention has arisen to mitigate and/or obviate the afore-described disadvantages.

SUMMARY OF THE INVENTION

The major object of the present invention is to provide a fan structure which provides preferable air circulation effect.

To achieve the above and other objects, a fan of the present invention is provided, including a driving member providing a driving power, a fan bracket, a main fan and a main cover.

The fan bracket is assembled with the driving member, and the fan bracket has a first connecting portion and a second connecting portion.

The main fan is disposed on the first connecting portion, and the main fan has a first face and a second face which is corresponding to the first face. The first face is protrudingly formed with a plurality of fan blades, and the fan blades extend radially from a center of the main fan toward a periphery of the main fan.

The main cover is disposed on the second connecting portion, and the main cover has a third face and a fourth face which is corresponding to the third face. The third face faces the first face, and an airflow space is formed between the third face and the first face. The main cover is formed with at least one first wind-guiding cover with each first wind-guiding cover being concave from the third face toward the fourth face, and the first wind-guiding cover has a first passage penetrating through the third face and the fourth face. Two ends of the first passage have a first opening and a second opening respectively. The first opening faces the first face, and the second opening faces in compliance with a rotating direction of the main cover.

Thereby, when the driving member drives the main fan to rotate, air can be inhaled from the first wind-guiding cover into the airflow space. Using the guiding effect of the first wind-guiding cover, after air enters the airflow space, air is guided outwardly toward a periphery of the airflow space to achieve preferable airflow circulation effect.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
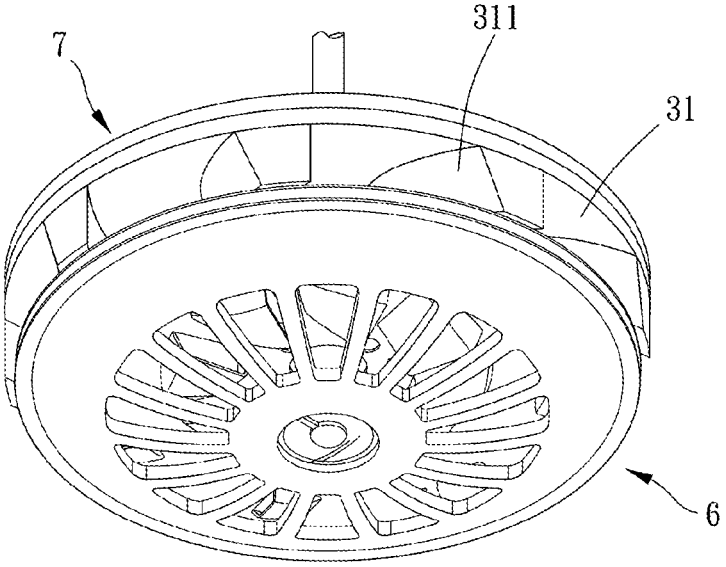
FIG. 1 is a perspective view of a present invention.
Figure 2:
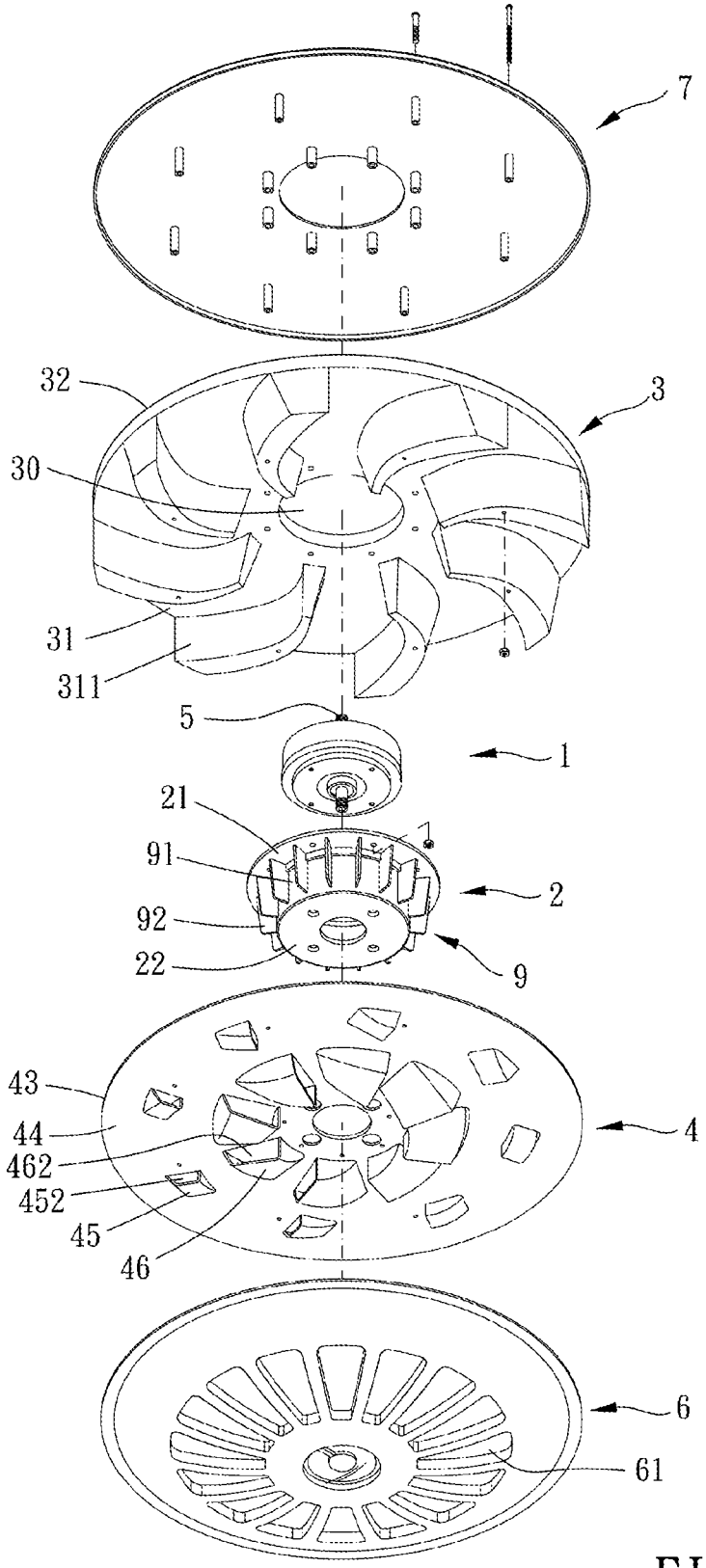
FIG. 2 is a breakdown view of the present invention.
Figure 3:
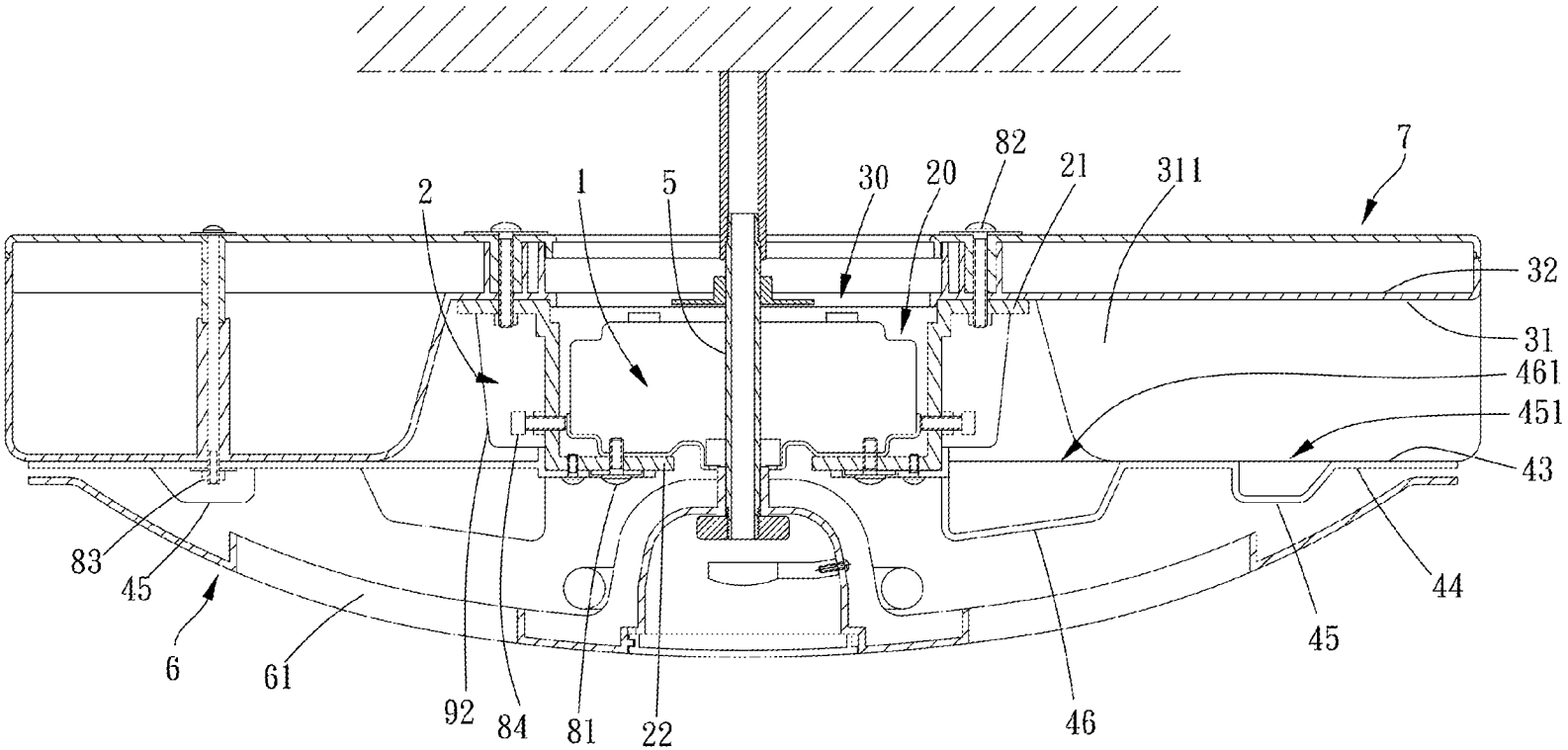
FIG. 3 is a cross-sectional view of the present invention.

Please refer to FIGS. 1 to 3 for a fan of the present invention, including a driving member 1, a fan bracket 2, a main fan 3 and a main cover 4.

The driving member 1 is for providing driving power. The driving member 1 in this embodiment is an electric motor.

The fan bracket 2 is assembled with the driving member 1. The fan bracket 2 in this embodiment has a hollow structure. The fan bracket 2 has a receiving space 20 provided for receiving the driving member 1, and two ends of the fan bracket 2 have a first connecting portion 21 and a second connecting portion 22 respectively. More specifically, the fan bracket 2 is cylindrical. The first connecting portion 21 extends radially outwardly from an end of the fan bracket 2 as an annular sheet, and the second connecting portion 22 extends radially outwardly from the other end of the fan bracket 2 as an annular sheet. A plurality of locking holes is formed on the first and second connecting portions 21, 22.

The main fan 3 is disposed on the first connecting portion 21, and a through hole 30 is formed at a center of the main fan 3. The fan bracket 2 shields the through hole 30 (the first connecting portion 21 surrounds the through hole 30). The receiving space 20 communicates with the through hole 30, and the driving member 1 is movable to enter into or exit from the receiving space 20 via the through hole 30. The main fan 3 has a first face 31 and a second face 32 which is corresponding to the first face 31. The first face 31 is protrudingly formed with a plurality of fan blades 311, and the fan blades 311 extend radially from the center of the main fan 3 toward a periphery of the main fan 3. Each fan blade 311 is curved (in other embodiments, the fan blade 311 can be straight).

The main cover 4 is disposed on the second connecting portion 22, and the main cover 4 has a third face 43 and a fourth face 44 which is corresponding to the third face 43. The third face 43 faces the first face 31, and an airflow space is formed between the third face 43 and the first face 31 (The third face 43 and the first face 31 are parallel to each other). The main cover 4 is formed with a plurality of first wind-guiding covers 45 and a plurality of second wind-guiding covers 46, and the first wind-guiding covers 45 and the second wind-guiding covers 46 are concave from the third face 43 toward the fourth face 44. The first wind-guiding cover 45 has a first passage which penetrates through the third face 43 and the fourth face 44, and two ends of the first passage have a first opening 451 and a second opening 452 respectively. The first opening 451 faces the first face 31, and the second opening 452 faces in compliance with a rotating direction of the main cover 4 (a tangent direction of the main cover 4). The second wind-guiding cover 46 has a second passage which penetrates through the third face 43 and the fourth face 44, and two ends of the second passage have a third opening 461 and a fourth opening 462 respectively. The third opening 461 faces the first face 31, and the fourth opening 462 faces in compliance with the rotating direction of the main cover 4 (a tangent direction of the main cover 4). The first wind-guiding cover 45 and the second wind-guiding cover 46 have the same shape, and a cross-sectional shape of either of the first wind-guiding cover 45 and the second wind-guiding cover 46 is substantially U-shaped (in other embodiments, the cross-sectional shape can be curved). The second wind-guiding cover 46 is greater than the first wind-guiding cover 45 in volume. Each first wind-guiding cover 45 and each second wind-guiding cover 46 are annularly arranged, and the first wind-guiding cover 45 is relatively more remote from a center of the main cover 4 than the second wind-guiding cover 46.

In addition, this embodiment further includes a fixing shaft 5, a decorative board 6 and an upper cover 7. The driving member 1 is rotatably disposed about the fixing shaft 5 (a bearing is disposed between the driving member 1 and the fixing shaft 5), and the fixing shaft 5 is disposed through the main fan 3, the fan bracket 2 and the main cover 4. The decorative board 6 is disposed at an end of the fixing shaft 5 and shields the fourth face 44 of the main cover 4, and the decorative board 6 has a plurality of air holes 61; wherein the decorative board 6 can be further formed with lighting devices or ozone sterilization devices. The upper cover 7 is disposed on the second face 32 of the main fan 3.

Thereby, the main fan 3, the fan bracket 2 and the main cover 4 are disposed between the upper cover 7 and the decorative board 6. The main cover 4, the second connecting portion 22 of the fan bracket 2 and the driving member 1 are inserted by a plurality of fixing members 81 to be fixed; and the upper cover 7, the main fan 3 and the first connecting portion 21 of the fan bracket 2 are inserted by a plurality of fixing members 82 to be fixed. An end of each fan blade 311 is a plane and contacts the third face 43 in surface contact. Each fan blade 311 and the main cover 4 are inserted by a plurality of fixing members 83 to be fixed.

Figure 4:
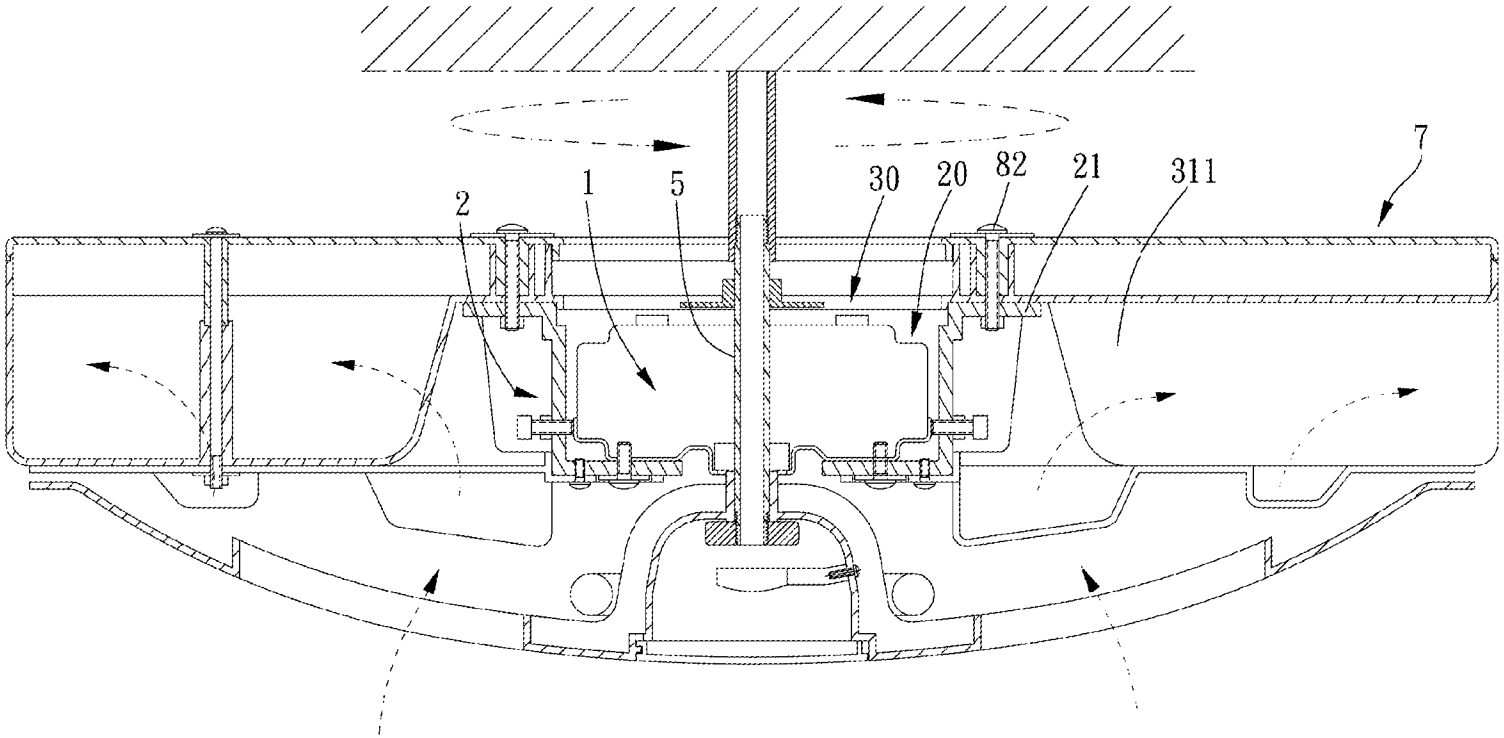
FIG. 4 is a drawing showing the present invention in use.

In actual practice, the fan of the present invention is mounted on the ceiling via the fixing shaft 5. During the operation process, the driving member 1 drives the main fan 3 and the main cover 4 to rotate. By a rotation effect of the fan blades 311, air in an interior space is inhaled from the first wind-guiding cover 45 and the second wind-guiding cover 46 (air is blocked by the first face 31 and stays in the airflow space). By the guiding effect of the first wind-guiding cover 45 and the second wind-guiding cover 46, air enters the airflow space and is exhaled along the tangent direction of main cover 4 (as shown in FIGS. 3 and 4) toward a periphery of the main cover 4 so as to achieve airflow circulation effect.

The fan of the present invention inhales air from the first wind-guiding cover 45 and the second wind-guiding cover 46 and quickly exhales air outwardly to achieve preferable circulation effect in the interior space. Therefore, by using the fan, air flows smoothly, effectively and evenly through the interior space.

Furthermore, this embodiment further includes an auxiliary fan 9. The auxiliary fan 9 is disposed on the fan bracket 2, and the auxiliary fan 9 is surrounded by the fan blades 311. The auxiliary fan 9 has an annular body 91 and a plurality of sheets 92 which are disposed on an outer surface of the annular body 91 and extend outwardly, and the annular body 91 is disposed around the fan bracket 2. The third opening 461 of each second wind-guiding cover 46 faces a space between each sheet 92 and each fan blade 311 (as shown in FIG. 3). The auxiliary fan 9 and the fan bracket 2 are inserted by a plurality of fixing members 84 to be fixed, and each fixing member 84 abuts against the driving member 1. Thereby, when the driving member 1 is operating, the auxiliary fan 9 is actuated to rotate to improve airflow to flow laterally so as to enhance airflow circulation efficiency.

It is to be noted that the driving member 1 is movable to enter into or exit from the receiving space 20 through the through hole 30; that is, when the driving member 1 is mounted, the driving member 1 can be put into the receiving space 20 and fixed through the through hole 30; and when the driving member 1 is dismounted, the driving member 1 can be taken out from the through hole 30. It is convenient to mount or dismount the driving member 1.

Figure 5:
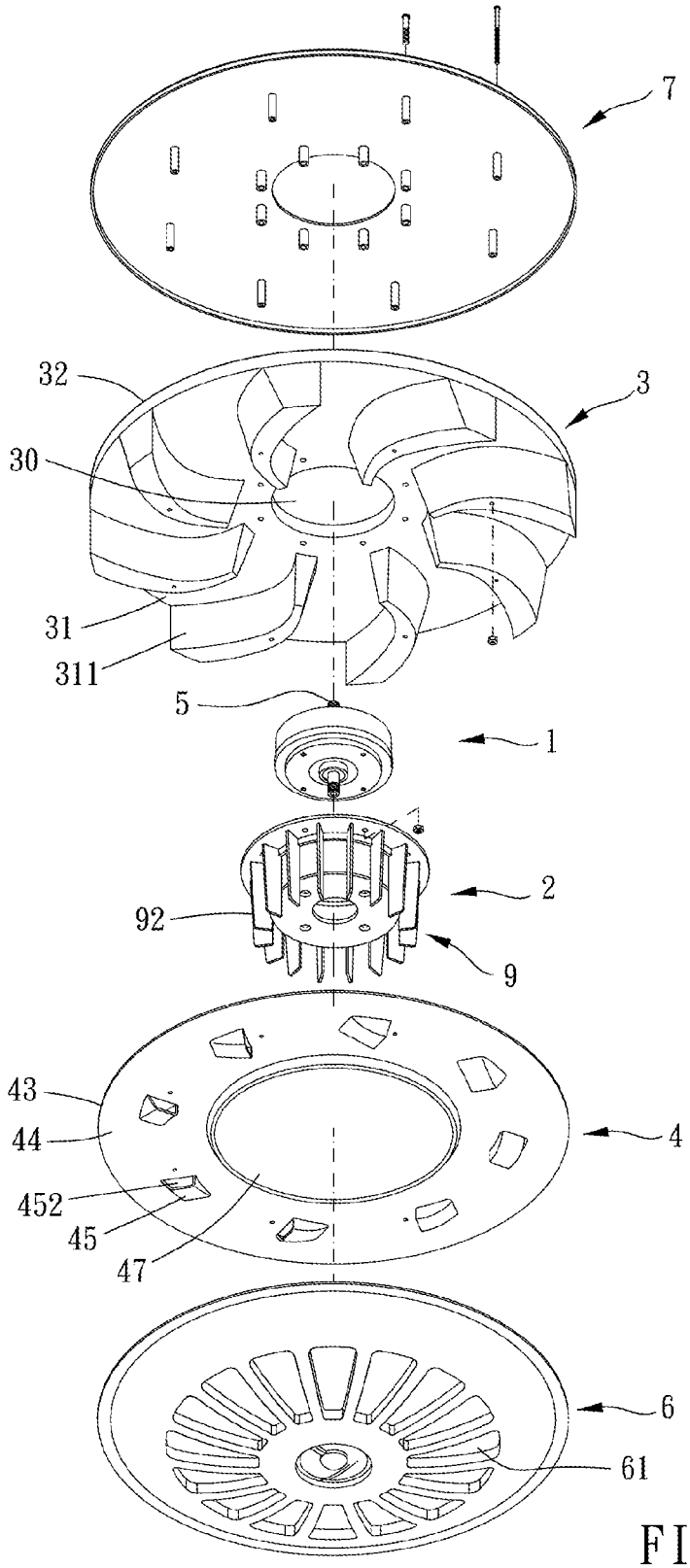
FIG. 5 is a breakdown view of a second embodiment of the present invention.
Figure 6:
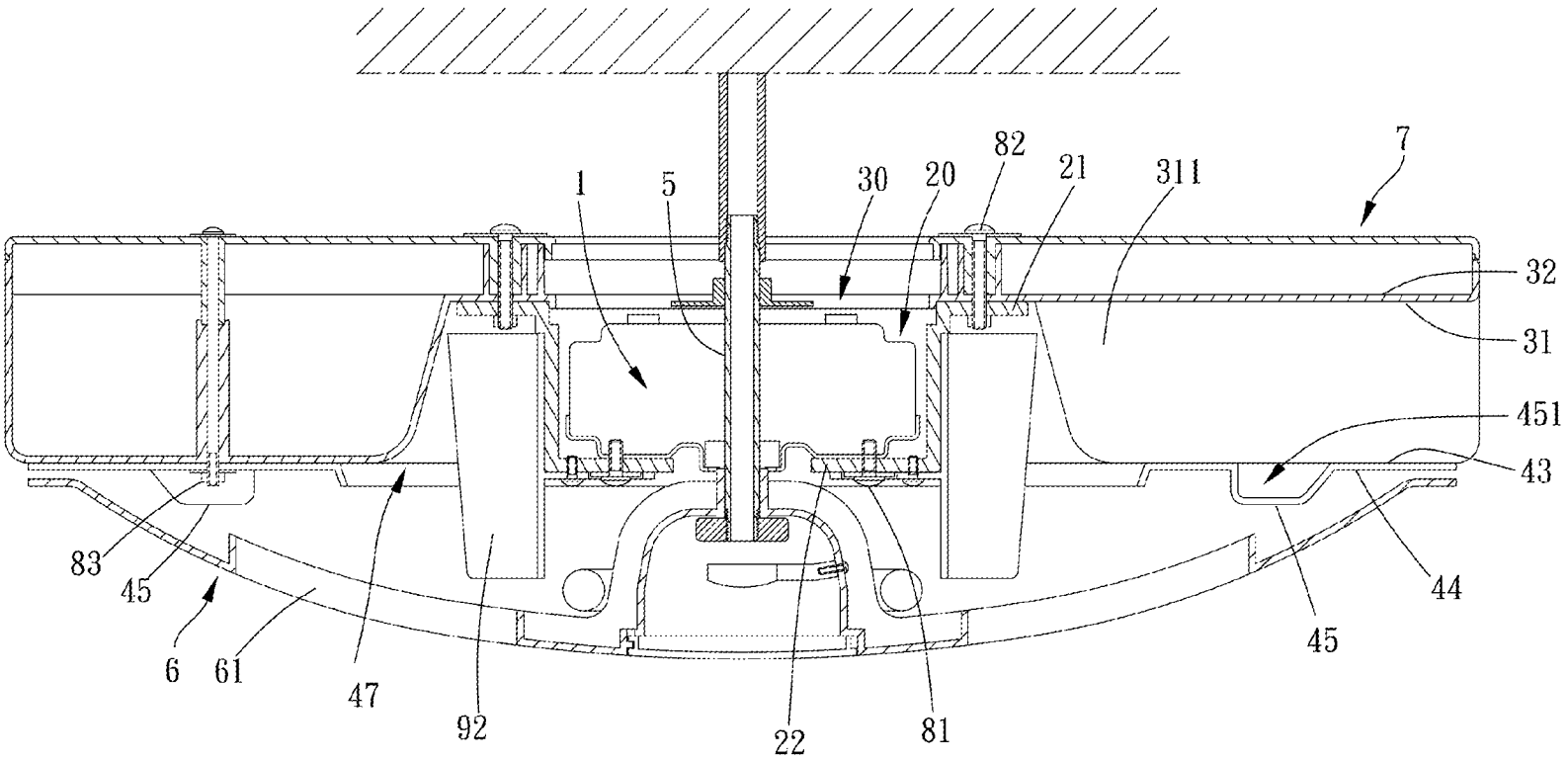
FIG. 6 is a cross-sectional view of the second embodiment of the present invention.
Figure 7:
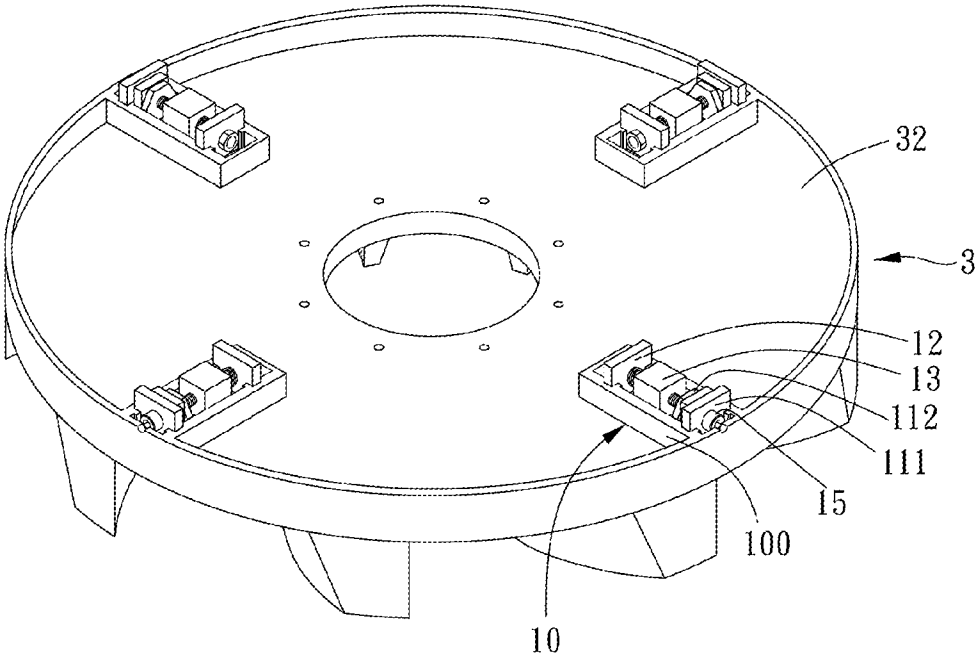
FIG. 7 is a partial perspective view of a third embodiment of the present invention.
Figure 8:
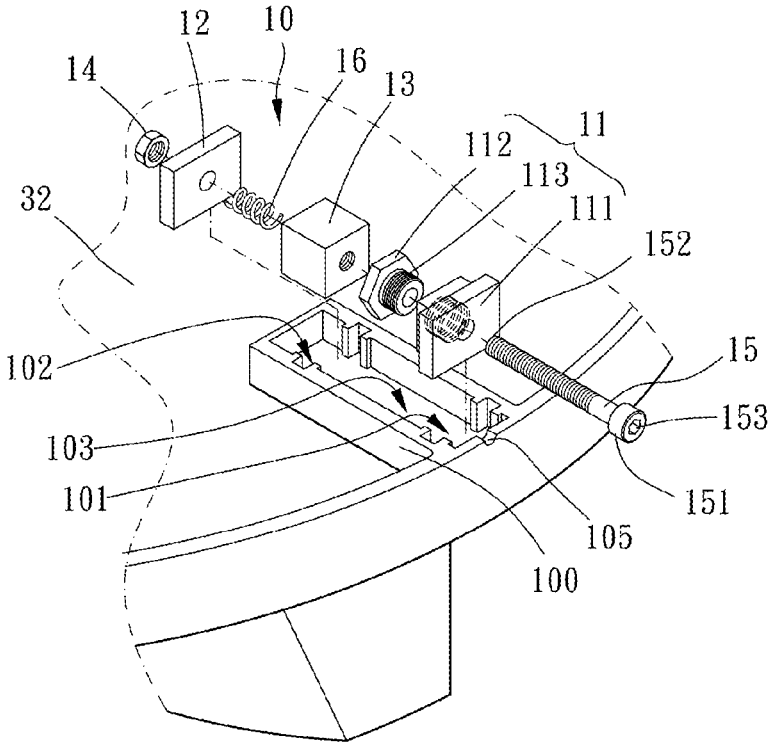
FIG. 8 is a breakdown view of a balance-adjusting mechanism of the third embodiment of the present invention.
Figure 9:
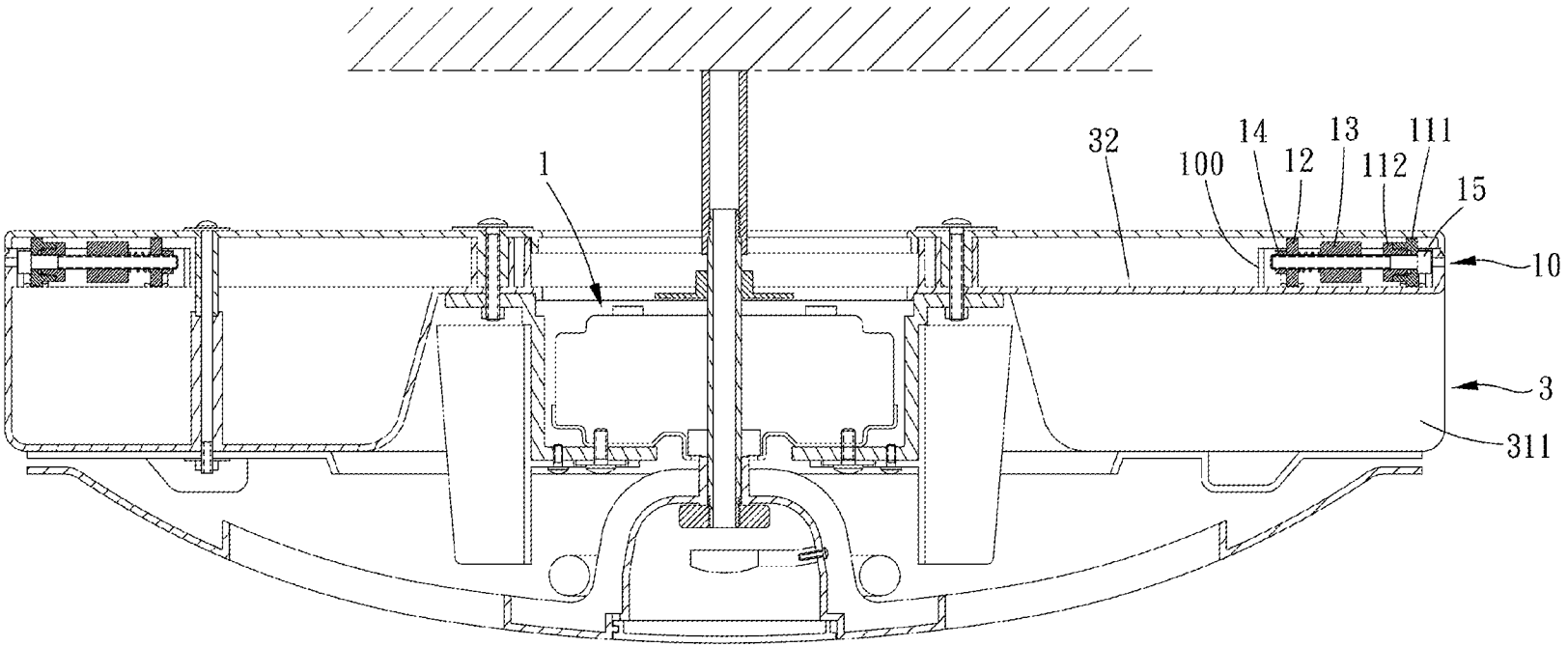
FIG. 9 is a cross-sectional view of the third embodiment of the present invention.

In addition, in a second embodiment of the present invention (please refer to FIGS. 5 and 6), the main cover 4 has a hole 47, and the sheets 92 of the auxiliary fan 9 penetrates through the hole 47 and is positioned between the main cover 4 and the decorative board 6; therefore, the hole 47 can increase a hollow-out area of the main cover 4 to increase air inflow, and the lengthened sheet 92 helps to guide airflow toward the periphery of the main cover 4 to increase airflow circulation effect.

Figure 11:
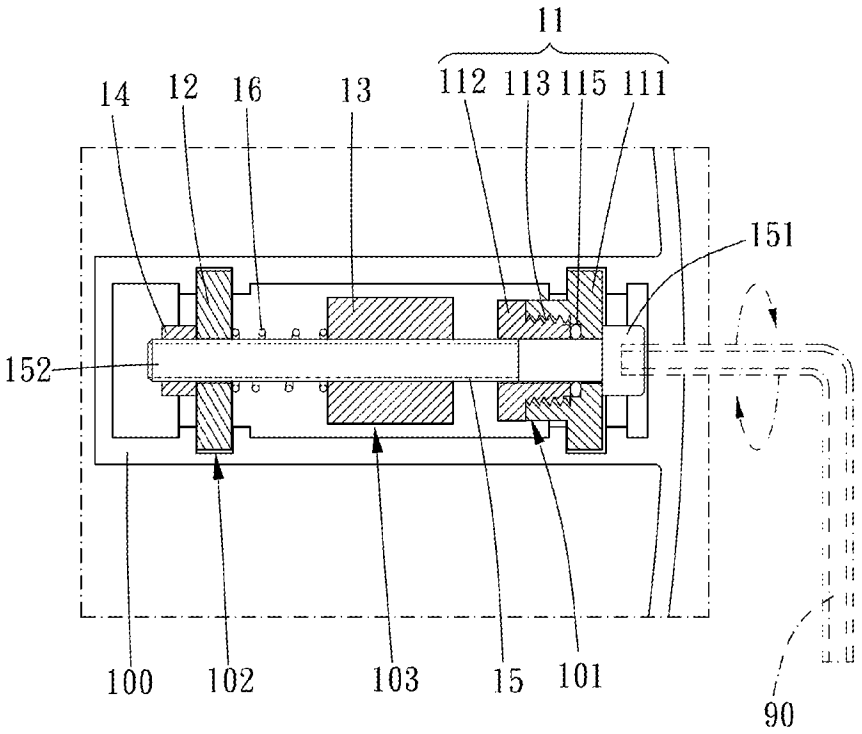
FIGS. 10 and 11 are drawings showing the balance-adjusting mechanism of the third embodiment of the present invention in use.
Figure 10:
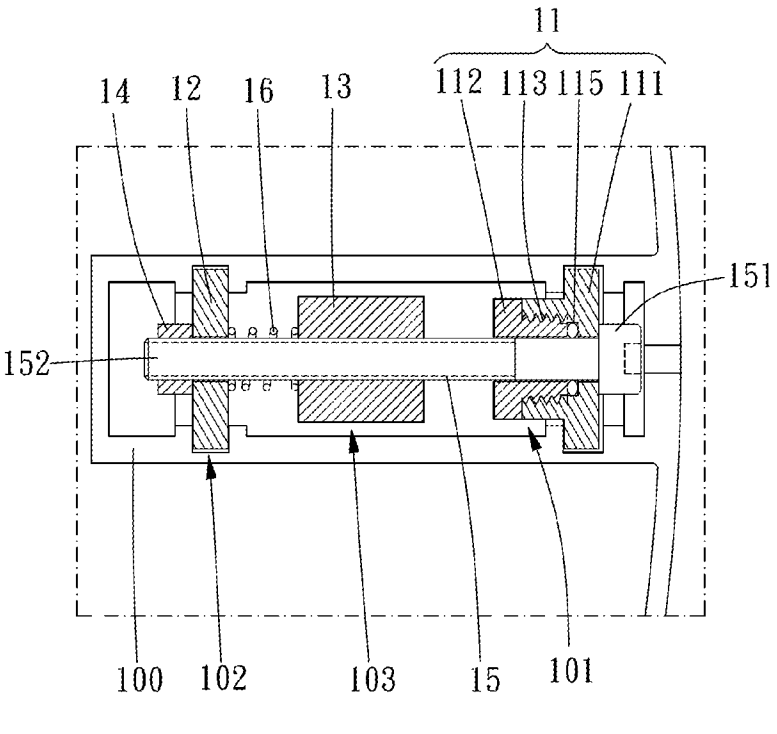

Please refer to FIGS. 7 to 11 for another embodiment of the present invention, further including a balance-adjusting mechanism 10. The balance-adjusting mechanism includes a connecting base 100, a first positioning member 11, a second positioning member 12, a balance block 13, a fixing member 14 and an adjusting shaft 15. The connecting base 100 has a receiving portion, and the receiving portion is formed with the first positioning member 11, the balance block 13, the second positioning member 12 and the fixing member 14 sequentially from an end to the other end, wherein the receiving portion has a first receiving slot 101, a second receiving sot 102 and a third receiving slot 103. The third receiving slot 103 is located between the first receiving slot 101 and the second receiving slot 102. The first positioning member 11 and the second positioning member 12 are disposed in the first receiving slot 101 and the second receiving slot 102 respectively. The balance block 13 is substantially cylindrical and movably disposed in the third receiving slot 103. The adjusting shaft 15 is disposed in the receiving portion of the connecting base 100, and the adjusting shaft 15 is disposed through the first positioning member 11, the balance block 13 and the second positioning member 12 with a distal end thereof being fixed by the fixing member 14. The adjusting shaft 15 is rotatable relative to the connecting base 100 and rotatable relative to the first and second positioning members 11, 12. The adjusting shaft 15 has a first end 151 and a second end 152 which is corresponding to the first end 151, and the second end 152 is fixed by the fixing member 14 (in this embodiment, the fixing member 14 is a screw nut and screwedly connectable with the second end 152 of the adjusting shaft 15, and in other embodiments, the fixing member can be a C-clip or other fixing structures). The second positioning member 12 is provided for the fixing member 14 to abut thereagainst, and the first positioning member 11 is provided for the first end 151 to abut thereagainst; wherein the first positioning member 11 has an abutting block 111 and a restriction member 112, the restriction member 112 is screwedly connected with the abutting block 111, the restriction member 112 has an insert end 113, the abutting block 111 has an insert hole, the insert end 113 is screwed to the insert hole, and the abutting block 111 is disposed in the first receiving slot 101 of the receiving portion and provided for the first end 151 to abut thereagainst. The adjusting shaft 15 is screwedly connected with the balance block 13 (the balance block 13 is formed with a screw hole for the adjusting shaft 15 to be disposed therethrough); therefore, when the adjusting shaft 15 rotates, the balance block 13 is actuated by a screw thread to move along an axial direction of the adjusting shaft 15 (as shown in FIGS. 10 and 11). A cross-section of the abutting block 111 is substantially square to prevent the abutting block 111 from rotating relative to the first receiving slot 101, a cross-section of the second positioning member 12 is substantially square to prevent the second positioning member 12 from rotating relative to the second receiving slot 102 and a cross-section of the balance block 13 is substantially square to prevent the balance block 13 from rotating relative to the third receiving slot 103.

The connecting base 100 is disposed on the main fan 3. Specifically, the connecting base 100 is disposed on the second face 32, the adjusting shaft 15 is disposed along a radial direction of the main fan 3, the first end 151 of the adjusting shaft 15 has a driving portion 153 for a tool to be connected thereto (please refer to FIGS. 8, 10 and 11) and the driving portion 153 is a hexagonal hole for a hexagonal wrench 90 to be connected thereto; wherein the connecting base 100 has a recessive slot 105 provided for the hexagonal wrench 90 to extend into the driving portion 153. The driving portion 153 faces an outer side of the main fan 3, and the fixing member 14 is near the center of the main fan 3. Each balance-adjusting mechanism 10 is radially arranged about and evenly around the main fan 3 (a number and a position of the balance-adjusting mechanism can be adjusted according to various requirements).

When a balance of the fan is adjusted (please refer to FIGS. 8, 10 and 11), the hexagonal wrench 90 is used to drive the adjusting shaft 15 to rotate through the driving portion 153. When the adjusting shaft 15 rotates relative to the connecting base 100, the balance block 13 moves along the axial direction of the adjusting shaft 15 relative to the connecting base 100; therefore, a center of gravity of the main fan 3 may change through change of position of the balance block 13, so as to adjust the balance of the fan.

Therefore, compared with conventional fans, the balance of the fan of the present invention can be adjusted before, after or during the assembling process of the fan. The balance of the fan can be adjusted by rotating the adjusting shaft 15 from outside, and there is no need of assembling counterweight blocks or conducting complicated operations. The fan is convenient and easy for a consumer to assemble.

In addition, in this embodiment, an elastic member 16 is formed between the balance block 13 and the second positioning member 12. The elastic member 16 is a spiral spring and disposed around the adjusting shaft 15. The elastic member 16 is provided for supporting and abutting against the balance block 13 so as to prevent the balance block 13 from shaking and moving randomly on the adjusting shaft 15 and to ensure the balance block 13 to stay in the same position after adjustment. Furthermore, a fitness an adjustment of the balance block 13, adjusting shaft 15 and the second positioning member 12 can be enhanced to prevent the fan from making noises when operating.

Furthermore, an elastic O-ring 115 is disposed between the restriction member 112 and the abutting block 111, and the O-ring 115 is disposed around the insert end 113 of the restriction member 112; therefore, when the adjusting shaft 15 rotates and abuts against the abutting block 111, the O-ring 115 can buffer between the restriction member 112 and the abutting block 111 and enhance an adjustment of the adjusting shaft 15, restriction member 112 and the abutting block 111. Thereby, the fan can be prevented from making noises when operating, and the adjusting shaft 15 can be prevented from dislocating so as to ensure the fan runs smoothly and stably.

While we have shown and described various embodiments in accordance with the present invention, it should be clear to those skilled in the art that further embodiments may be made without departing from the scope of the present invention.

What is claimed is:

1. A fan, including:

a driving member, for providing driving power;

a fan bracket, being assembled with the driving member, the fan bracket having a first connecting portion and a second connecting portion;

a main fan, disposed on the first connecting portion, the main fan having a first face and a second face which is corresponding to the first face, the first face being protrudingly formed with a plurality of fan blades, the fan blades extending radially from a center of the main fan toward a periphery of the main fan;

a main cover, disposed on the second connecting portion, the main cover having a third face and a fourth face which is corresponding to the third face, the third face facing the first face and an airflow space being formed between the third face and the first face, the main cover being formed with at least one first wind-guiding cover concave from the third face toward the fourth face, the first wind-guiding cover having a first passage penetrating through the third face and the fourth face, two ends of the first passage having a first opening and a second opening respectively, the first opening facing the first face, the second opening facing in compliance with a rotating direction of the main cover; and a balance-adjusting mechanism, the balance-adjusting mechanism including a connecting base, a first positioning member, a second positioning member, a balance block, a fixing member and an adjusting shaft, the connecting base disposed on the main fan, the connecting base having a receiving portion, the receiving portion including the first positioning member, the balance block, the second positioning member and the fixing member from an end to another end sequentially, the adjusting shaft penetrating sequentially through the first positioning member, the balance block, the second positioning member and the fixing member with a distal end thereof being fixed by the fixing member, the adjusting shaft being rotatable relative to the connecting base, the adjusting shaft screwedly connected with the balance block, when the adjusting shaft rotates relative to the connecting base, the balance block moves along an axial direction of the adjusting shaft relative to the connecting base.

2. The fan of claim 1, wherein the main fan is formed with a through hole at the center thereof, the fan bracket shields the through hole and has a receiving space for receiving the driving member, the receiving space communicates with the through hole, and the driving member is movable to enter into or exit from the receiving space via the through hole.

3. The fan of claim 1, further including an auxiliary fan, the auxiliary fan disposed on the fan bracket, and the auxiliary fan surrounded by the fan blades.

4. The fan of claim 3, wherein the auxiliary fan has an annular body and a plurality of sheets which are arranged on an outer surface of the annular body, and the annular body is disposed around the fan bracket.

5. The fan of claim 4, wherein the main cover is formed with a hole, the sheets of the auxiliary fan are disposed through the hole and positioned between the main cover and a decorative board which shields the fourth face of the main cover.

6. The fan of claim 3, wherein a plurality of fixing members are inserted in the auxiliary fan and the fan bracket to fix the auxiliary fan and the fan bracket, and each fixing member abuts against the driving member.

7. The fan of claim 1, wherein the main cover is further formed with at least one second wind-guiding cover concave from the third face toward the fourth face, the second wind-guiding cover has a second passage penetrating through the third face and the fourth face, two ends of the second passage have a third opening and a fourth opening respectively, the third opening faces the first face, the fourth opening faces in compliance with the rotating direction of the main cover, and the first wind-guiding cover is relatively more remote from a center of the main cover than the second wind-guiding cover.

8. The fan of claim 7, wherein the main cover has a plurality of the first wind-guiding covers and a plurality of the second wind-guiding covers, and the first wind-guiding covers and the second wind-guiding covers are annularly arranged respectively.

9. The fan of claim 7, further including an auxiliary fan, the auxiliary fan disposed on the fan bracket and positioned between the first face and the third face, the auxiliary fan surrounded by the fan blades, the auxiliary fan having a plurality of sheets extending outwardly, and the third opening of each second wind-guiding cover facing a space between each sheet and each fan blade.

10. The fan of claim 1, further including a fixing shaft and a decorative board, the driving member rotatably disposed about the fixing shaft, the fixing shaft penetrating through the main fan, the fan bracket and the main cover, the decorative board disposed at an end of the fixing shaft and shielding the main cover, and the decorative board having a plurality of air holes.

11. The fan of claim 1, wherein the receiving portion has a first receiving slot, a second receiving slot and a third receiving slot, the third receiving slot is located between the first and second receiving slots, the first positioning member and the second positioning member are disposed in the first receiving slot and the second receiving slot respectively, and the balance block is movably disposed in the third receiving slot.

12. The fan of claim 11, wherein the adjusting shaft has a first end and a second end which is corresponding to the first end, the second end is fixed by the fixing member, the second positioning member is provided for the fixing member to abut thereagainst, and the first positioning member is provided for the first end to abut thereagainst.

13. The fan of claim 11, wherein a cross-section of the second positioning member is substantially square to prevent the second positioning member from rotating relative to the second receiving slot, and a cross-section of the balance block is substantially square to prevent the balance block from rotating relative to the second receiving slot.

14. The fan of claim 1, wherein the adjusting shaft has a first end and a second end which is corresponding to the first end, the second end is fixed by the fixing member, the first positioning member has an abutting block and a restriction member, the restriction member and the abutting block are screwedly connected with each other, the abutting block is disposed in the receiving portion and provided for the first end to abut thereagainst, wherein an elastic O-ring is disposed between the restriction member and the abutting block.

15. The fan of claim 1, wherein the adjusting shaft is rotatable relative to the first positioning member and the second positioning member, and the fixing member is screwedly connected with the adjusting shaft.

16. The fan of claim 1, wherein an elastic member is disposed between the balance block and the second positioning member.

17. The fan of claim 1, wherein the adjusting shaft is disposed along a radial direction of the main fan, the adjusting shaft has a driving portion for a tool to be connected thereto, the driving portion faces an outer side of the main fan, and the fixing member is near the center of the main fan.

* * * * *